United States Patent [19]

Pulido

[11] Patent Number: 4,615,785

[45] Date of Patent: Oct. 7, 1986

[54] CLIP FOR ANODIZING BATH AND METHOD OF USING THE CLIP

[76] Inventor: Robert J. Pulido, 24508 Leona Dr., Hayward, Calif. 94542

[21] Appl. No.: 733,982

[22] Filed: May 13, 1985

[51] Int. Cl.[4] ..... C25D 17/04

[52] U.S. Cl. ..... 204/297 W; 204/297 R; 248/229; 248/230; 248/231; 248/231.8; 269/254 R

[58] Field of Search ..... 204/297 R, 297 W; 248/229-231, 231.8, 316.7; 339/251, 252 R, 255 R; 269/130, 131, 132, 254 R

[56] References Cited

U.S. PATENT DOCUMENTS

| | | | |
|---|---|---|---|
| 1,221,507 | 4/1917 | Buesse | 248/231 |
| 3,013,959 | 12/1961 | Ventre | 204/297 W |
| 3,108,058 | 10/1963 | Mines et al. | 204/297 W |
| 3,970,540 | 7/1976 | McBain | 204/297 W |
| 4,079,481 | 3/1978 | Cacicedo | 248/230 |
| 4,085,997 | 4/1978 | Hainsworth | 204/297 W |
| 4,176,039 | 11/1979 | Wismer | 204/297 W |
| 4,309,263 | 1/1982 | Boyd | 248/231 |

FOREIGN PATENT DOCUMENTS

| | | | |
|---|---|---|---|
| 2731699 | 2/1978 | Fed. Rep. of Germany | 204/297 W |

*Primary Examiner*—Terryence Chapman
*Attorney, Agent, or Firm*—Robert Charles Hill

[57] ABSTRACT

A clip is disclosed of a type for securing workpieces to a bar forming part of a framework for suspending the workpieces in a bath suitable for anodizing or other electrolytic treatment of the workpieces. The clip has an elongated body with tapered engagement teeth at both ends thereof for arrangement adjacent the bath bar. A central portion of the clip body is adapted for engagement with a flexible band which is wrapped around the bar for resiliently urging the clip against the bar. In use, either end of the clip may be moved away from the bar, preferably by using a tool fitting into slots on the clip body for positioning a workpiece between either end of the clip and the bar. The clip is of a uniform cross-sectional configuration adapted for extrusion whereby a plurality of the clips may be formed by transversely cutting an extruded member conforming with the cross-section of the clip.

7 Claims, 10 Drawing Figures

CLIP FOR ANODIZING BATH AND METHOD OF USING THE CLIP

FIELD OF THE INVENTION

The present invention relates to a clip for securing workpieces to a bath bar in electrolytic processes and more particularly to such a clip adapted for use in anodizing baths together with a method for forming the clip and a method for using the clip.

BACKGROUND OF THE INVENTION

A number of different constructions of clips or the like for securing workpieces in place upon bath bars or other frameworks have been disclosed in the prior art.

Generally, anodizing operations are similar to other electrolytic processes in that workpieces or parts to be anodized or electrolytically treated, must be secured and suspended in various corrosive baths. For example, in conventional anodizing operations, the workpieces are first suspended in a caustic bath for cleaning their surfaces and conditioning them for the anodizing operation. The workpieces are then suspended in an acid tank employed for anodizing. In the acid tank, electrolytic conditions are developed within the bath commonly by employing the walls of the tank as a cathode and an overhead I-beam for coupling the workpiece as an anode. A framework including bath bars extending downwardly into the tank are connected to the overhead beam and are adapted for supporting the workpieces. The workpieces must of course be in conductive engagement with the overhead beam through the bath bars in order for the process to be carried out.

With the above arrangement and with the workpiece for example being aluminum, a current is then caused to pass through the bath for converting the surface of the workpieces to an aluminum oxide coating. The current employed per square foot of workpiece surface area, the time for the process and selection of coloring agents, etc., are of course well known in the electrolytic art.

In any event, the acid tank employed for the anodizing operation is particularly corrosive to all parts of the supporting framework that are suspended within the bath. These parts of course include any means for securing the workpieces to the bath bars.

In the prior art, it was common to employ C-clamps which were conventionally used for clamping the work pieces against the bath bar and thus suspending them within the bath. Although these clamps worked satisfactorily for the purpose, they were found to be very time consuming.

Other clamping arrangements are disclosed for example in U.S. Pat. No. 3,108,058 issued Oct. 22, 1963 to Mines et al and U.S. Pat. No. 3,013,959 issued to Ventre on Dec. 19, 1961.

In the first noted patent, a relatively complex resilient rocker assembly was employed to form a clamp for mounting workpieces on a bath bar and assuring conductive engagement of the workpieces with the bath bars.

The second patent noted above disclosed the use of angled members formed on the bath bars with wedging members being resiliently urged toward the angled members in order to secure workpieces against the bath bar.

Both of these references provided certain improvements over by both of these patents also exhibited certain shortcomings. For example, they were either secured by bolts to the bath bars or included elements on the bath bars so that they could only function in one position. In addition, the clamping mechanisms provided by both of these patents were also relatively complex, requiring substantial time either for installation or mounting of the workpieces. At the same time, since both combinations included parts which were subject to corrosion within the bath, they also exhibited a relatively limited operating life.

In any event, there has been found to remain a need for an improved clamp or device for securing workpieces to a bath bar in anodizing or other electrolytic operations.

SUMMARY OF THE INVENTION

It is therefore an object of the invention to provide an improved clip suitable for use in applications such as those outlined above while overcoming numerous problems of the type also described above.

It is more particularly an object of the invention to provide such a clip having an elongated body with first and second engagement means formed at each end thereof, the clip being urged against a bath bar by a resilient band wrapped around the bar for causing the clip body to maintain one or more workpieces in conductive engagement with the bath bar.

It is a further related object of the invention to provide such a clip wherein the first and second engagement means project outwardly relative to a central portion of the clip body so that each of the first and second engagement means is capable of being withdrawn from engagement with the bar for receiving a workpiece therebetween, interaction of the resilient band between the clip and bar thereafter urging the workpiece into conductive engagement with the bar.

Preferably, the clip is formed with a plurality of tapered teeth forming each of the first and second engagement means, the means formed centrally on the body for engagement with the flexible band comprising a transverse bore adapted for receiving a bolt and nut for engagement with opposite ends of the resilient band.

It is further preferred that the clip be relatively massive in order to resist corrosion in the bath. At the same time, it is also preferred that the clip have a uniform cross-sectional configuration adapting it for formation by extrusion. For this purpose, the bore formed at the center of the clip body is formed by an open slot along one surface of the body. In this manner, the bore can be formed by extrusion along with other features of the clip body. Thereafter, it is contemplated that an extruded member having a cross-sectional configuration as described above may be simply cut or sliced transversely into sections, the sections forming respective clips according to the present invention.

A clip constructed in accordance with the present invention has a number of important advantages. Initially, the clip is of particularly simple design having only an integral clip body together with the resilient band and means for securing the band to the clip body. It has also been found that the clip of the present invention has a surprisingly long life, particularly within the harsh environment of the electrolytic or anodizing baths. For example, it has been found that the clip of the present invention may be used in as many as one hundred cycles or anodizing operations contrasted with the five to ten cycles noted above for the prior art. In addition, the clip of the present invention is self-adjusting because of the resilient band in that workpieces of widely varying thicknesses may be secured by the clip. For example, one size of clip contemplated within the invention may be employed with workpieces as thin as one eighth inch for example and as thick as two and one half to three inches for example. At the same time, the clip is extremely versatile in that it may be positioned anywhere along the length of the bath bar and may be used for securing workpieces under both ends of the clip. Furthermore, each clip can be used for securing workpieces of widely varying thicknesses under its opposite ends.

Further related objects of the invention include a method for forming such a clip by extrusion and a method for using the clip in accordance with the advantages set forth above.

Additional objects and advantages of the invention will be apparent from the following description and drawings which are provided only by way of example and are not intended to limit the scope of the invention.

A BRIEF DESCRIPTION OF THE DRAWINGS

Figure 5:
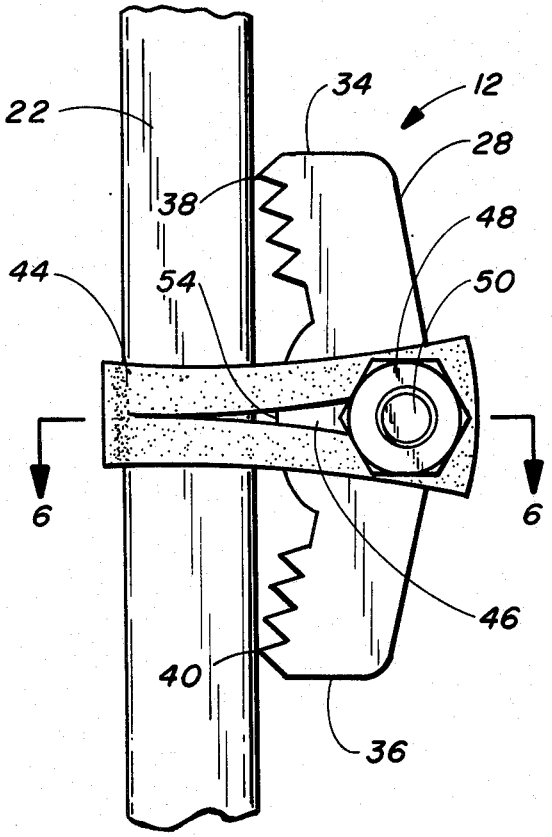
FIG. 5 is a side view of a clip mounted on one bath bar.
Figure 7:
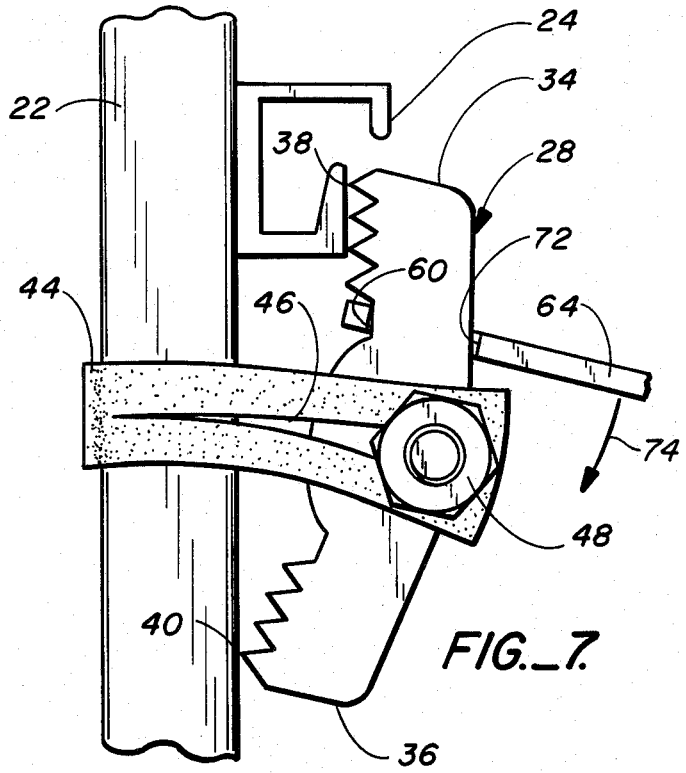
Figure 8:
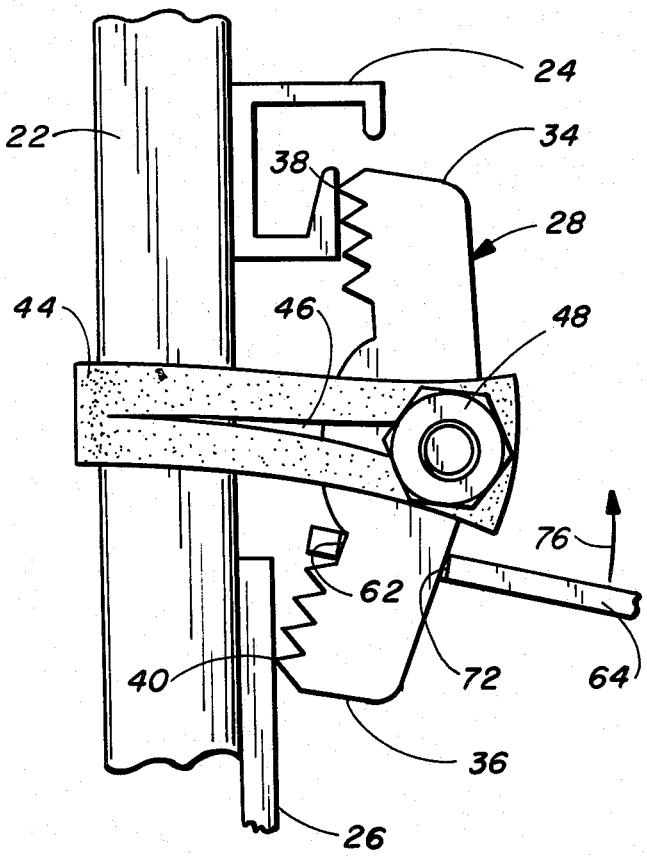

FIGS. 7 and 8 together with FIG. 5 illustrate in sequence the manner in which the clip of the present invention may be employed to secure a workpiece under one end thereof and optionally a second workpiece under the other end of the clip.

Figure 9:
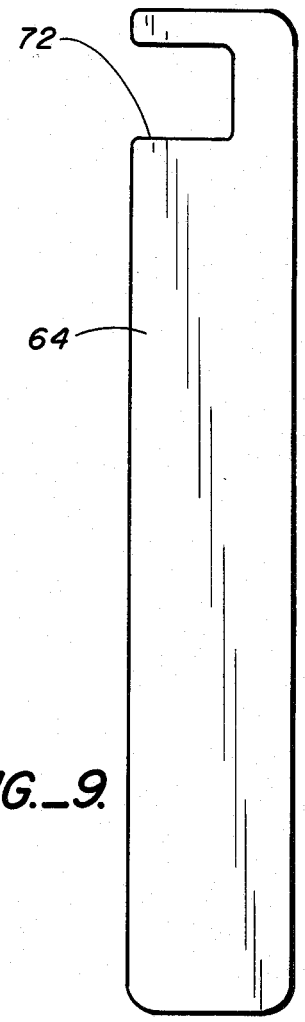

FIG. 9 illustrates a tool novelly adapted for use with the clip of the present invention to force its opposite ends away from the bath bar for receiving a workpiece therebetween.

Figure 10:
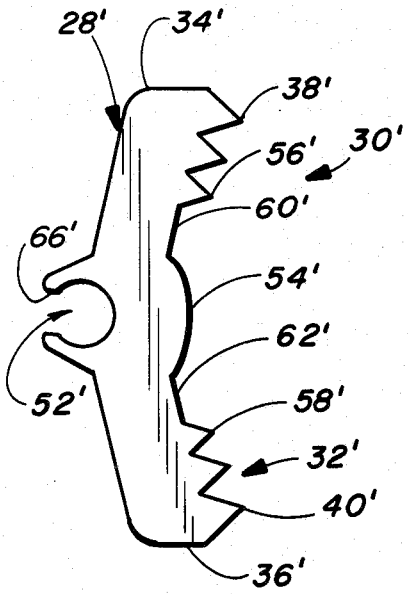

FIG. 10 illustrates another embodiment of the clip of the invention.

DESCRIPTION OF THE PREFERRED EMBODIMENTS

Figure 1:
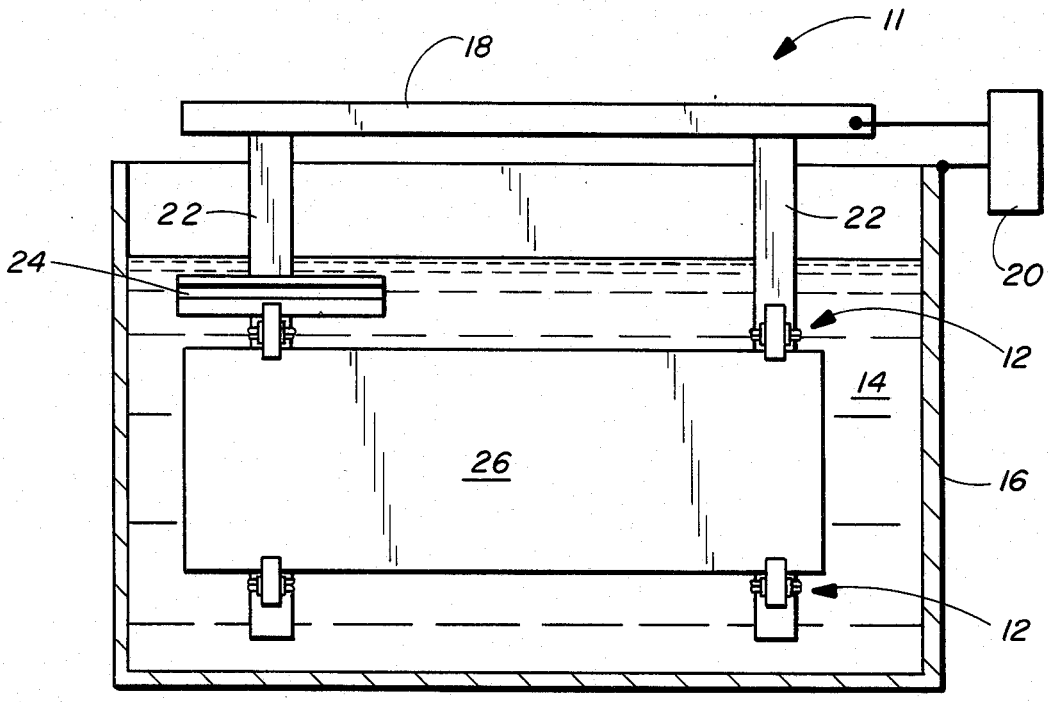
FIG. 1 is a partial schematic side view in elevation of an anodizing tank wherein the clip of the present invention is employed.

Referring now to the drawings and particularly to FIG. 1, the present invention relates to a clip for securing workpieces to be anodized or otherwise electrolytically processed in an anodizing assembly of the type generally indicated at 11 in FIG. 1. Multiple clips constructed and employed within the assembly 11 and in accordance with the present invention are both generally indicated at 12. Although anodizing processes employing acid tank baths of the type indicated at 11 in FIG. 1 are well known in the art, the system is briefly described below in order to assure an understanding of the present invention.

In the processing system 11 of FIG. 1, a suitable acid for carrying out an anodizing operation is indicated at 14 in a tank 16 in further accordance with the prior art, an overhead I-beam 18 and the walls of the tank 16 itself form opposing electrodes for carrying out the electrolytic anodizing process and are accordingly interconnected by a source 20 of electrical potential.

Further details of the electrolytic assembly and parameters for its operation are not believed necessary herein since they are well known in the prior art. In any event, the overhead beam 18 includes a conductive framework comprising bath bars 22 extending downwardly from the overhead beam 18 into the acid bath 14.

Workpieces of different configurations such as the extruded bar 24 and the flat sheet 26 are suspended within the acid bath 14 in conductive contact with the overhead beam 18 through the bath bars 22. The processing assembly ten is thus adapted for anodizing or otherwise electrolytically processing the workpieces 24 and 26 by imposing a suitable electrical potential between the overhead beam 18 and the tank 16 for causing a current to flow through the acid bath 14 between the tank 16 and the workpieces 24 and 26 since they are conductively engaged with the bath bars 22 and the overhead beam 18.

The clip 12 of the present invention is described in greater detail below followed by a description of a preferred method for forming the clip and a novel method of using the clip within the anodizing assembly 11.

Figure 2:
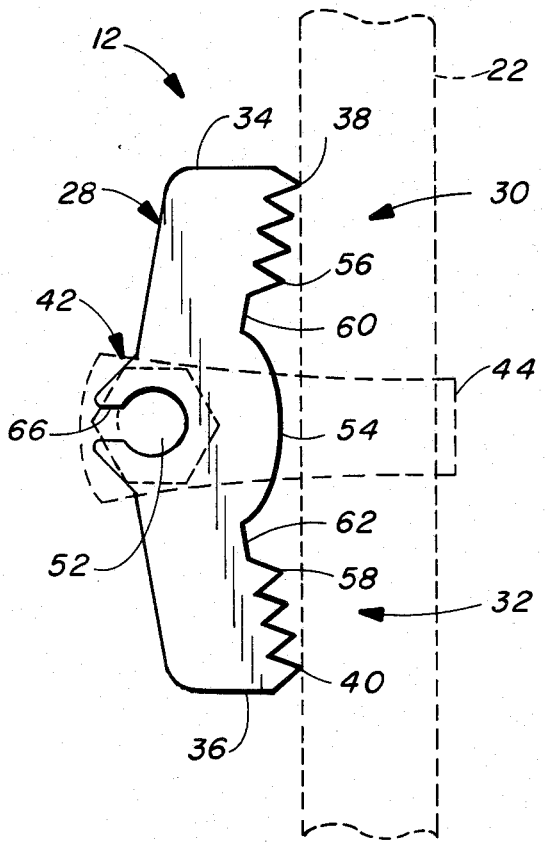
FIG. 2 is a side view in elevation of the clip of the present invention, a bath bar and a resilient band adapted for engaging the clip with the bath bar being shown in phantom.
Figure 3:
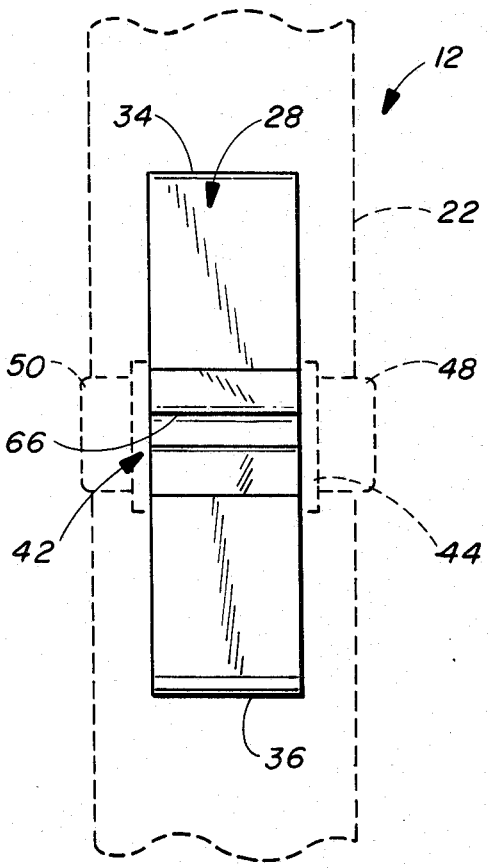
FIG. 3 is a view taken from the left side of FIG. 2 with the bath bar, the resilient band and means for securing the band to the clip also being shown in phantom.
Figure 4:
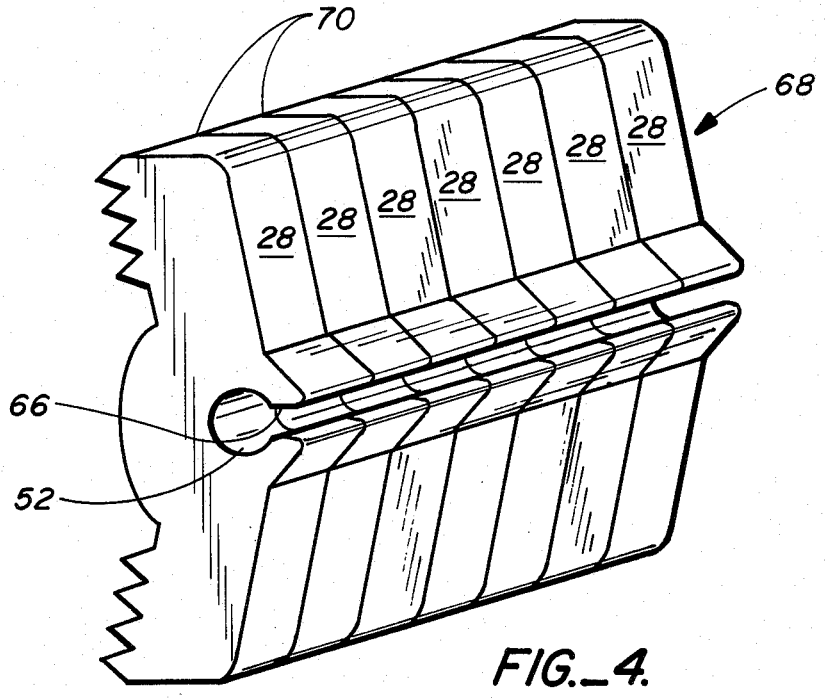
FIG. 4 is a view of a single extruded member having a cross-sectional configuration corresponding to the clip of the present invention and illustrating the manner in which a plurality of clips may be formed from the single extruded member by simple transverse cuts.
Figure 6:
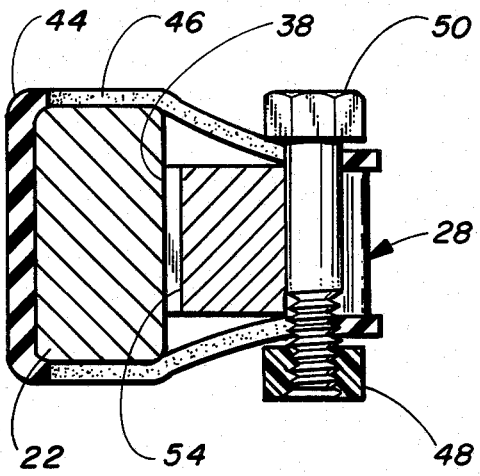
FIG. 6 is a cross-sectional view taken along section line 6—6 of FIG. 5.

Turning now to FIGS. 2 and 3 together with FIGS. 5 and 6, the clip 12 of the present invention comprises a unitary elongated body 28 having engagement means or teeth 30 and 32 respectively formed at opposite ends 34 and 36 of the elongated body 28. The engagement teeth 30 and 32 are arranged on one side of the body so that they can both be positioned against one of the bath bars 22.

As may be best seen in FIGS. 2 and 5, the engagement means 30 and 32 are formed as tapered sets of teeth with outer teeth 38 and 40 in the respective engagement means 30 and 32 projecting outwardly the furtherest from the elongated body 28 so that they always tend to be in engagement with the bar 22 or with a workpiece as described in greater detail below.

Attachment means 42 are arranged at a central portion of the elongated body 28 for connection with a resilient flexible band 44 adapted to be engaged with the clip body 28 and wrapped around the bath bar 22 for holding the clip in place relative to the bar 22 and for urging the engagement teeth 30 and 32 against the bar 22.

Preferably, the resilient band 44 is formed as an elongated member having slits 46 cut into each end thereof. At the same time, the attachment means 42 preferably comprises a nut and bolt assembly 48 and 50 adapted to penetrate a bore 52 formed transversely in the body 28. The bolt 50 also penetrates the slits 46 in the opposite end of the band 44 so that the band is held in place relative to the bar 22 and the clip body 28 as illustrated in the above noted figures.

All portions of the clip 12 together with the nut and bolt combination 48, 50 and the resilient band 44 are immersed in the acid bath 14 and accordingly must be capable of withstanding that harsh environment. For that purpose, the clip body 28 is preferably formed from a similar metal as the bath bars 22 or a plastic such as polypropylene. In the assembly 11 of FIG. 1, both the bath bars 22 and the clip bodies 12 are preferably formed from conventionally known aluminum alloys. The nut 48 and bolt 50 are preferably formed from nylon for the same reason while the resilient band 44 is formed from a rubber selected for maintaining its resiliency under both the corrosive conditions of the bath 14 and relatively high temperatures often developed therein. The resilient band 44 is also formed of a predetermined length so that when it is wrapped around the bath bar 22 as illustrated in the above noted figures, it applied substantial force in tension to the clip body 28.

Because of the notch effect formed in the clip body 12 by the bore 52, an opposite portion of the elongated body is formed as a protruding or rounded reinforcement area 54 providing generally constant cross-sectional mass along the length of the body 28. The rounded reinforcement area 54 is preferably formed with a radius as best seen in FIG. 2 so that it falls approximately in line with the inner teeth 56 and 58 respectively of the engagement means 30 and 32.

The clip body 28 is also formed with notches 60 and 62 between the rounded reinforcement area 54 and the inner teeth 56 and 58 respectively. The notches 60 and 62 are formed generally on opposite ends of the elongated body 28 in order to adapt the body 28 for use with a tool 64 described in greater detail below and shown in FIG. 9. As will be described in greater detail below, the tool 64 of FIG. 9 is employed for pulling either or both ends of the clip body 28 away from the bar 22 for inserting workpieces therebetween.

In accordance with the preceding description, the various means formed on the clip body 28 are arranged on exposed surfaces of the body. At the same time, an elongated member 68 is illustrated having a cross-sectional configuration corresponding to that described above for the clip body 28. Because of the design of the clip body 28 and particularly because of the slot 66 in communication with the bore 52, the entire clip body 28 can be formed by extrusion. Accordingly, after the elongated member 68 is formed by extrusion, it is cut or sliced as indicated in numerous positions at 70 to form a plurality of sections or individual clip bodies in accordance with the present invention. At the same time, the transverse dimension of the sections or clip bodies may readily be adjusted simply by repositioning the cuts in the elongated member 68. Also, through the formation of the clip body 28 in this manner, it is formed as a relatively massive structure better adapted for resisting corrosion within an acid bath such as that indicated at 14 in FIG. 1.

The manner in which the clip 12 of the present invention is used in conjunction with the nut and bolt 48, 50 and the resilient band 44 is believed obvious from the preceding description. However, its method of use is described in greater detail below particularly to demonstrate the manner of use for the tool 64 and to assure a complete understanding of the invention.

Referring now to FIGS. 5–8, the clip body 28 is initially positioned adjacent one of the bath bars 22 and held in that position by the resilient band 44. Thus, the position of the clip 12 on the bath bar can be readily adjusted and any number of clips can be positioned along each of the bath bars.

In order to employ the clip 12 for positioning a workpiece on the bath bar, one end of the clip body 28 is engaged by the tool 64, for example as illustrated in FIG. 7. Referring to FIG. 7, a notch 72 is formed in the tool 64 to conform to the cross-sectional configuration of the clip body 28 adjacent either of the notches 60 and 62. Referring again to FIG. 7, the tool 64 is thus engaged for example with the notch 60. The tool 64 is then forced downwardly as indicated by the arrow 74 to provide leverage force on the elongated body 28 for urging its upper end 34 and especially the outer tooth 38 away from the bar 22.

With the clip body 28 maintained in this position, one workpiece, for example that also indicated at 24 in FIG. 1 can readily be inserted between the bath bar 22 and the engagement means 30 including the outer tooth 38 on the upper end 34 of the clip body 28. With the clip body 28 then being released by the tool 64, the engagement means 30 and particularly the outer tooth 38 is forced against the workpiece 24 by the resilient band 44 in order to maintain the workpiece 24 in position and in conductive engagement with the bath bar 22.

Thereafter, a second workpiece corresponding for example with that illustrated at 26 in FIG. 1 may then be held in place on the bath bar 22 by the other end of the same clip 12. For that purpose, the tool 64 is then similarly engaged in the notch 62 toward the other end 36 of the clip body 28. With upward force then being applied to the tool 64 as illustrated by the arrow 76, the lower end 36 of the body 28 and particularly the outer tooth 40 is forced away from the bar 22 in order to permit the workpiece 26 to be inserted therebetween. With the workpiece 26 in that position, the clip body 28 is again released by the tool 64 so that the resilient strap 44 applies force through both ends of the clip body 28 for positioning both of the workpieces 24 and 26 while maintaining them in conductive engagement with the bath bar 22. At the same time, it may be best seen in Figure 8 that the clip 12 is adapted for securing workpieces of substantially different dimension upon the bath bar 22. In addition to the substantial differences in thicknesses illustrated for the workpieces 24 and 26, they may also be of widely varying configurations for example if desired.

Another embodiment of a clip constructed according to the invention is illustrated at 12' in FIG. 10. Elements of the clip 12' in FIG. 10 corresponding to similar elements of the clip 12 in FIGS. 2–8 are indicated with similar primed numerical labels.

The clip 12' of FIG. 10 has a slightly different shape body 28'. In particular, the outer teeth 38' and 40' are relatively large with the remaining teeth tapering in size as well as position. These changes in the clip 12' are believed to provide for an even longer operating life because of the larger outer teeth 38' and 40' and the increased transverse distance between the teeth 38' and 40' and the bolt 50.

Accordingly, there has been described above a novel clip for use in anodizing or other electrolytic processing baths together with a novel method of forming the clip body by extrusion and a novel method for use of the clip in such an electrolytic bath assembly. Numerous modifications are believed apparent in addition to those indicated above. Accordingly, the scope of the present invention is defined only by the following appended claims.

What is claimed is:

1. In a method for securing workpieces to a bar forming part of a framework for suspending the workpieces to a bar forming part of a framework for suspending the workpieces in a bath suitable for anodizing or other electrolytic treatment, the steps comprising selecting a clip having an elongated body with first and second engagement means formed on one side of the body at opposite ends thereof and means on a central portion of the body adapted for engagement with a resilient flexible band, positioning the clip with the first and second engagement means against the bar, wrapping the resilient band around the bar and engaging it with the means on the central portion of the clip body, selectively pulling one of the first and second engagement means of the clip away from the bar, inserting a first workpiece therebetween, and releasing the one engagement means and allowing the flexible band to act through the clip for securing the first workpiece in conductive engagement with the bar.

2. The method of claim 1 further comprising the step of pulling the other of the first and second engagement means of the clip away from the bar, inserting a second workpiece therebetween, and releasing the other engagement means and allowing the resilient band to act through the clip for securing the first and second workpieces in conductive engagement with the bar.

3. A clip for securing workpieces to a bar forming part of a framework for suspending the workpieces in a bath suitable for anodizing or other electrolytic processes, the clip comprising an elongated body, first and second engagement means formed on one side of the body and at opposite ends thereof, means formed on a central portion of the body, a resilient flexible band adapted for being wrapped around the bar and for engagement with the means on the central portion for resiliently urging the first and second engagement means toward the bar, said first and second engagement means projecting outwardly relative to a central portion of the body on the one side thereof whereby each of the first and second engagement means can be withdrawn from engagement with the bar for receiving a workpiece therebetween, interaction of the resilient band between the clip and bar thereafter urging the workpiece into conductive engagement with the bar, and each of the first and second engagement means comprises a first tooth adjacent the respective end of the body and additional smaller teeth arranged in tapered relation on thebody with respect to the first tooth.

4. A clip for securing workpieces to a bar forming part of a framework for suspending the workpieces in a bath suitable for anodizing or other electrolytic processes, the clip comprising an elongated body, first and second engagement means formed on one side of the body and at opposite ends thereof, a transverse bore formed on a central portion of the body for receiving a shaft, a resilient flexible band adapted for being wrapped around the bar and for engagement with said shaft for resiliently urging the first and second engagement means toward the bar, and said first and second engagement means projecting outwardly relative to a central portion of thebody on the one side thereof whereby each of the first and second engagement means can be withdrawn from engagement with the bar for receiving a workpiece therebetween, interaction of the resilient band between the clip and bar thereafter urging the workpiece into conductive engagement with the bar.

5. The clip of claim 4 further comprising a nut and bolt forming the shaft.

6. The clip of claim 5 wherein the flexible band and the nut and bolt are formed from material selected for resisting corrosion from the bath.

7. A clip for securing workpieces to a bar forming part of a framework for suspending the workpieces in a bath suitable for anodizing or other electrolytic processes, the clip comprising an elongated body, first and second engagement means formed on one side of the body and at opposite ends thereof, means formed on a central portion of the body, a resilient flexible band adapted for being wrapped around the bar and for engagement with the means on the central portion for resiliently urging the first and second engagement means toward the bar, and means for engaging the resilient band with the central portion of the body.

* * * * *